US012011635B1

(12) United States Patent
Xiao et al.

(10) Patent No.: US 12,011,635 B1
(45) Date of Patent: Jun. 18, 2024

(54) MULTIFUNCTIONAL COMPREHENSIVE TRAINING DEVICE CAPABLE OF BEING GRASPED STABLY

(71) Applicant: QINGDAO IMBELL SPORTING GOODS CO., LTD., Qingdao (CN)

(72) Inventors: Tengqin Xiao, Qingdao (CN); Jichun Du, Qingdao (CN); Chunbo Xu, Qingdao (CN); Yan Shi, Qingdao (CN); Haotian Xie, Qingdao (CN)

(73) Assignee: QINGDAO IMBELL SPORTING GOODS CO., LTD., Qingdao (CN)

( * ) Notice: Subject to any disclaimer, the term of this patent is extended or adjusted under 35 U.S.C. 154(b) by 0 days.

(21) Appl. No.: 18/286,789

(22) PCT Filed: Apr. 20, 2023

(86) PCT No.: PCT/CN2023/089486

§ 371 (c)(1),
(2) Date: Oct. 13, 2023

(87) PCT Pub. No.: WO2023/174440

PCT Pub. Date: Sep. 21, 2023

(30) Foreign Application Priority Data

Aug. 8, 2022 (CN) ..... 202222078405.X

(51) Int. Cl.
*A63B 21/078* (2006.01)
*A63B 21/00* (2006.01)
(Continued)

(52) U.S. Cl.
CPC ..... *A63B 21/078* (2013.01); *A63B 21/0628* (2015.10); *A63B 21/0724* (2013.01); *A63B 21/156* (2013.01); *A63B 2225/102* (2013.01)

(58) Field of Classification Search
CPC ..... A63B 21/078; A63B 21/0628; A63B 21/0724; A63B 21/156; A63B 2225/102
See application file for complete search history.

(56) References Cited

U.S. PATENT DOCUMENTS

2022/0096891 A1 3/2022 Yang

FOREIGN PATENT DOCUMENTS

CN 108785963 B * 5/2020 ..... A63B 21/00065
CN 112704838 A 4/2021
(Continued)

*Primary Examiner* — Sundhara M Ganesan
*Assistant Examiner* — Jacqueline N L Loberiza
(74) *Attorney, Agent, or Firm* — Bayramoglu Law Offices LLC

(57) ABSTRACT

A multifunctional comprehensive training device capable of being grasped stably is provided. The multifunctional comprehensive training device capable of being grasped stably includes symmetrical front vertical pipes and symmetrical selected irons, where the front vertical pipes are provided vertically; cable mechanisms are respectively provided on the front vertical pipes; the cable mechanism includes a steel rope and a bracket; the steel rope includes a first end configured for a cable machine exercise, and a second end connected to a Smith mechanism through each of the selected irons; the Smith mechanism includes a guide post, a suspension rack, and an adjusting plate; the guide post is slidably connected to a moving rack; a barbell bar is horizontally provided at an upper end of the moving rack; the barbell bar is connected to a hook rack.

6 Claims, 3 Drawing Sheets

(51) Int. Cl.
*A63B 21/062* (2006.01)
*A63B 21/072* (2006.01)

(56) References Cited

FOREIGN PATENT DOCUMENTS

| | | | |
|---|---|---|---|
| CN | 213760353 | U | 7/2021 |
| CN | 214130079 | U | 9/2021 |
| CN | 216934577 | U | 7/2022 |
| CN | 217961137 | U | 12/2022 |
| EP | 3978084 | A1 | 4/2022 |
| WO | 2018086028 | A1 | 5/2018 |

* cited by examiner

MULTIFUNCTIONAL COMPREHENSIVE TRAINING DEVICE CAPABLE OF BEING GRASPED STABLY

CROSS REFERENCE TO THE RELATED APPLICATIONS

This application is the national phase entry of International Application No. PCT/CN2023/089486, filed on Apr. 20, 2023, which is based upon and claims priority to Chinese Patent Application No. 202222078405.X, filed on Aug. 8, 2022, the entire contents of which are incorporated herein by reference.

TECHNICAL FIELD

The present disclosure belongs to the field of strength training devices, and relates to a multifunctional comprehensive training device capable of being grasped stably.

BACKGROUND

A Smith machine and a cable machine are two essential fitness devices for the training ground and fitness room. However, due to limitations in space and procurement cost, the two trainers are not provided at the same time for home fitness, so as to limit the training and fitness to some extent.

Usually, the existing comprehensive trainer is a simple combination of the Smith machine and the cable machine, and includes most of the main components of the Smith machine and the cable machine. This causes a high manufacturing cost. Moreover, the training load of the Smith mechanism is restricted by the carrying load of the safety protection device on the machine frame. In actual use, the barbell bar is grasped unstably causing slip and rotation. Therefore, the existing comprehensive trainer is neither economic nor convenient.

SUMMARY

In view of defects in the prior art, a technical problem to be solved by the present disclosure is to provide a multifunctional comprehensive training device capable of being grasped stably. The present disclosure changes the existing simple combination of a Smith mechanism and a cable mechanism, and makes the Smith mechanism and the cable mechanism share a same set of selected irons. Moreover, the cable mechanism can be used as a safety limiting device of the Smith mechanism, such that the barbell bar is grasped stably. The present disclosure is operated simply, with material saving.

A multifunctional comprehensive training device capable of being grasped stably provided by the present disclosure includes front vertical pipes, selected irons, cable mechanisms, and Smith mechanisms, where the front vertical pipes are arranged symmetrically and vertically, and the selected irons are arranged symmetrically; the cable mechanisms are arranged symmetrically and are respectively provided on the front vertical pipes, and the Smith mechanisms are arranged symmetrically; the cable mechanism include a steel rope and a bracket; and a first end of the steel rope is configured for a cable machine exercise;

the Smith mechanisms each include a guide post, a suspension rack, and an adjusting plate; a second end of the steel rope is connected to the Smith mechanism through each of the selected irons; the guide post is provided vertically; the guide post is slidably connected to a moving rack; a barbell bar is horizontally provided at an upper end of the moving rack; the barbell bar is rotatably connected to the moving rack; the barbell bar is connected to a hook rack; two suspension shafts are provided on the hook rack; the two suspension shafts are respectively cooperated with the suspension rack and the adjusting plate; a support rack is provided at a lower end of the moving rack; and the support rack is configured to support the hook rack; and the suspension rack includes an upper end provided with a groove cooperated with the suspension shaft, and a lower end movably connected to a pulley; the second end of the steel rope is connected to the bracket through the pulley; and unidirectional teeth are provided on the adjusting plate.

Preferably, a hexagonal groove is formed in an upper end of the bracket; a hexagonal sleeve is horizontally provided at the lower end of the suspension rack; the hexagonal sleeve is cooperated with the hexagonal groove; a support shaft penetrates through the hexagonal sleeve; and the support shaft is rotatably connected to the pulley. When the barbell bar is used independently for an exercise, a load of the selected iron is removed from the barbell bar, such that the suspension rack and the bracket do not slide relatively, and a desirable stability is achieved.

Preferably, the cable mechanism further includes a sliding rack; the sliding rack is slidably connected to the front vertical pipe; a group of positioning holes are vertically formed in the front vertical pipe; a latch is provided on the sliding rack; and the latch is cooperated with each of the positioning holes. Not only is an initial position exercised by the Smith mechanism changed to exercise different positions, but also a safety limiting function can be achieved. Upon completion of an exercise, the barbell bar is placed down, the suspension rack falls onto the bracket under a gravity of the selected iron, and the load is removed.

Preferably, the hook rack is triangular; the barbell bar penetrates through one end of the hook rack; and two remaining ends of the hook rack are respectively provided with the suspension shafts, and respectively configured to connect the suspension rack and the adjusting plate. This reduces a rotational amplitude of the barbell bar, and makes the exercise more comfortable and convenient.

Compared with the prior art, the present disclosure achieves the following beneficial effects:

(1) With components such as the bracket and the suspension rack, the Smith mechanism and the cable mechanism can use a same set of selected irons as a load. The Smith mechanism does not use a weight plate as a load, which changes the conventional simple combination. Moreover, the support rack is provided on the moving rack, and the support rack is configured to support the hook rack. In a Smith machine exercise, the support rack can limit rotation of the hook rack, thereby ensuring a stability of the barbell bar in the exercise. Therefore, the present disclosure is operated simply, and used conveniently.

(2) The support rack is provided on the moving rack, and the support rack is configured to support the hook rack. In the Smith machine exercise, the support rack can limit rotation of the hook rack, thereby ensuring a stability of the hook rack in the exercise. The positioning hole cooperated with the sliding rack is formed in the front vertical pipe. By adjusting the mounting height of the sliding rack, not only can an initial position exercised by the Smith mechanism be adjusted to exercise different positions, but also a safety limiting function can be achieved. Upon completion of the exercise, the barbell bar is placed down, the suspension rack falls onto the bracket under a gravity of the selected iron, and the load of the selected iron is removed. Compared with a conventional Smith mechanism using a weight plate, this is safer and more reliable.

(3) The hexagonal sleeve is provided at the lower end of the suspension rack. The hexagonal groove is formed in the bracket. The hexagonal sleeve is cooperated with the hexagonal groove. When the barbell bar is used independently for an exercise, a load of the selected iron is removed from the barbell bar, such that the suspension rack and the bracket do not slide relatively, and a desirable stability is achieved.

In the figures: 1: front vertical pipe, 2: selected iron, 3: cable mechanism, and 4: Smith mechanism;

31: sliding rack, 32: steel rope, 33: bracket, and 34: pull sleeve;

41: guide post, 42: moving rack, 43: suspension rack, and 44: adjusting plate;

421: support rack, 422: barbell bar, 423: hook rack, and 424: suspension shaft; and

431: support shaft, and 432: pulley.

DETAILED DESCRIPTION OF THE EMBODIMENTS

Embodiment 1

Figure 1:
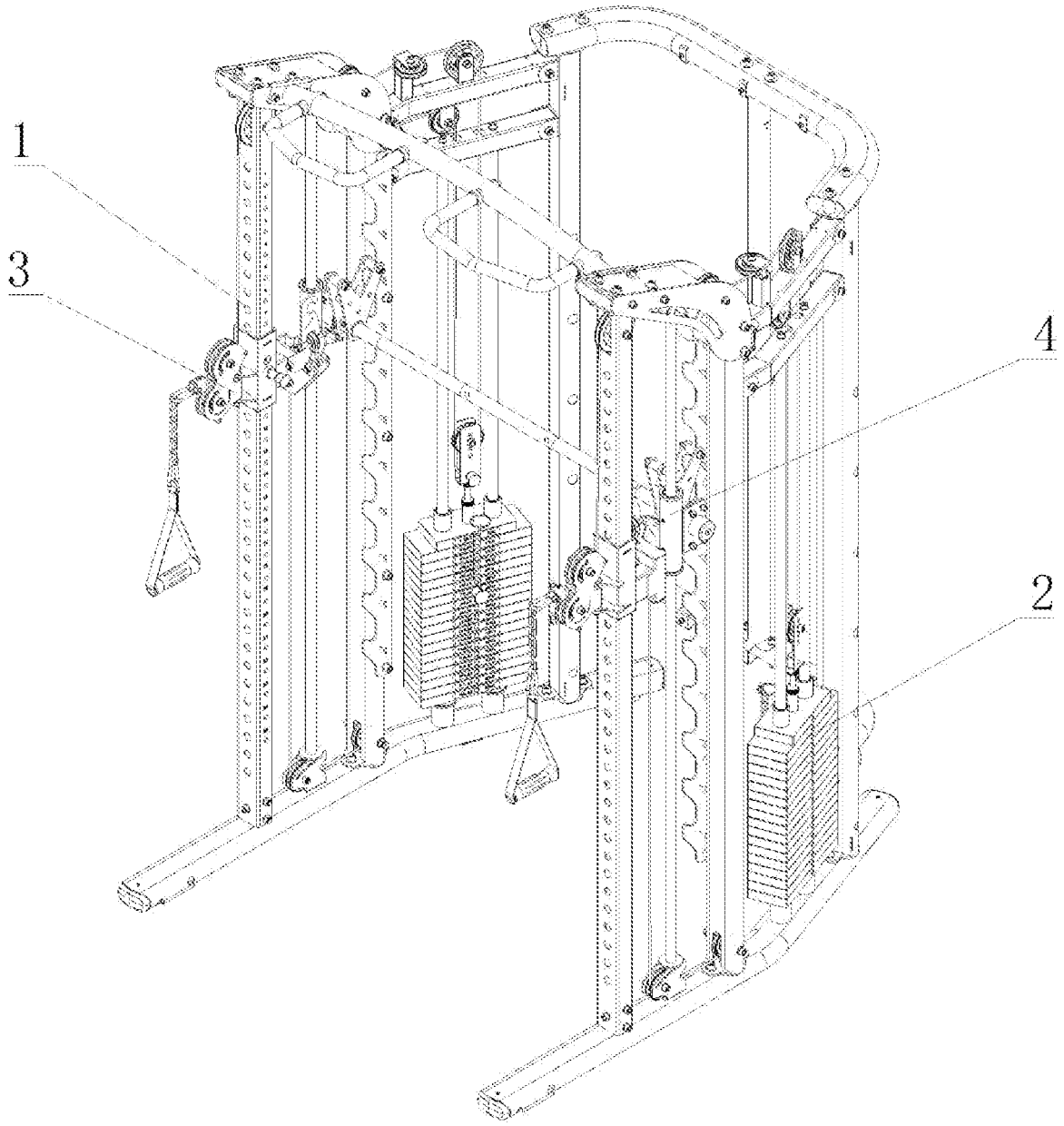
FIG. 1 is a schematic structural view according to an embodiment of the present disclosure.

As shown in FIG. 1, a multifunctional comprehensive training device capable of being grasped stably provided by the present disclosure includes front vertical pipes 1, selected irons 2, cable mechanisms 3, and Smith mechanisms 4. The front vertical pipes 1, selected irons 2, cable mechanisms 3 and Smith mechanisms 4 are arranged symmetrically. The front vertical pipes 1 are provided vertically. The cable mechanisms 3 are respectively provided on the front vertical pipes 1.

Figure 2:
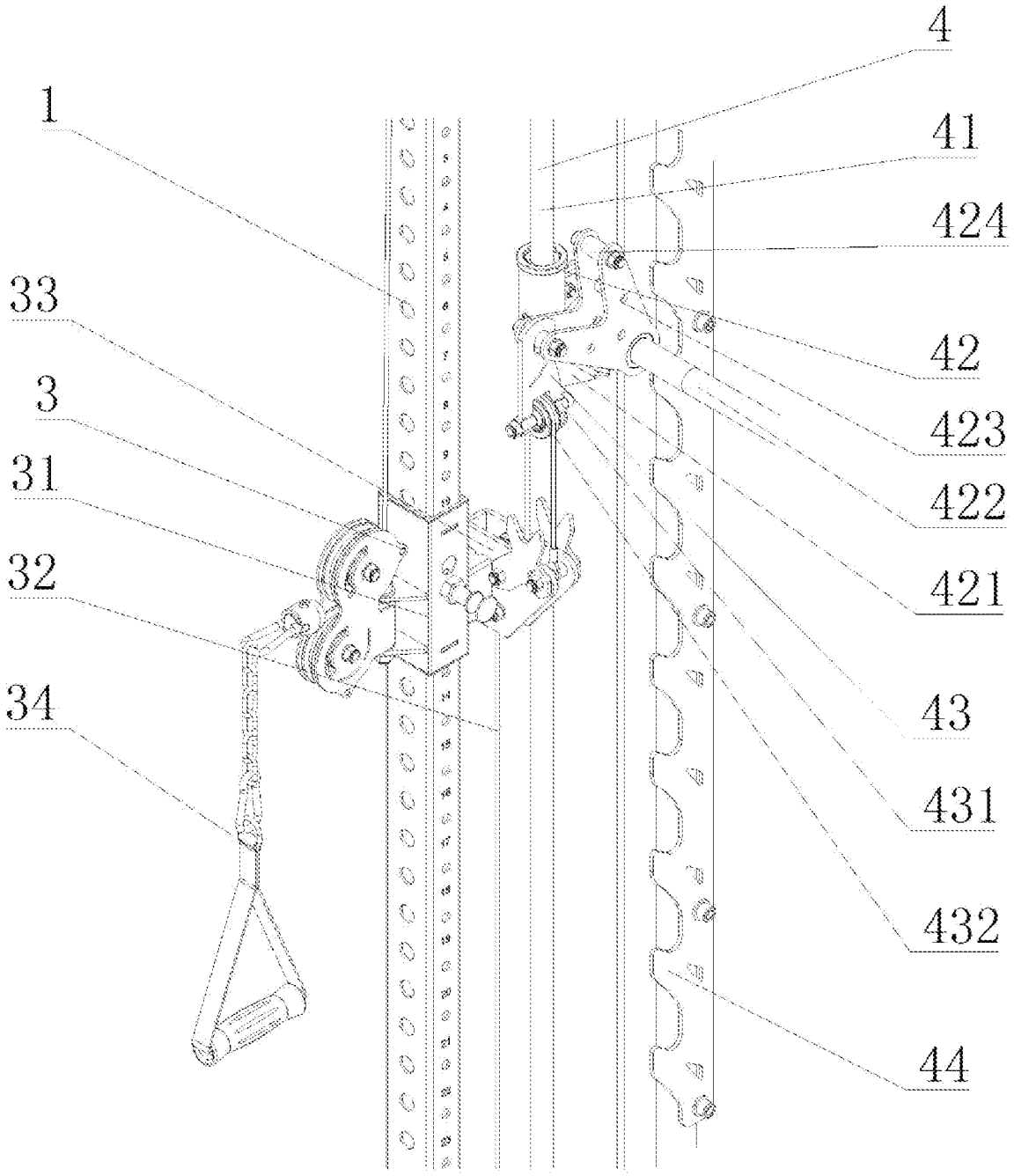
FIG. 2 is a schematic partial structural view illustrating a loaded state in which a Smith mechanism is connected to a selected iron according to the present disclosure.
Figure 3:
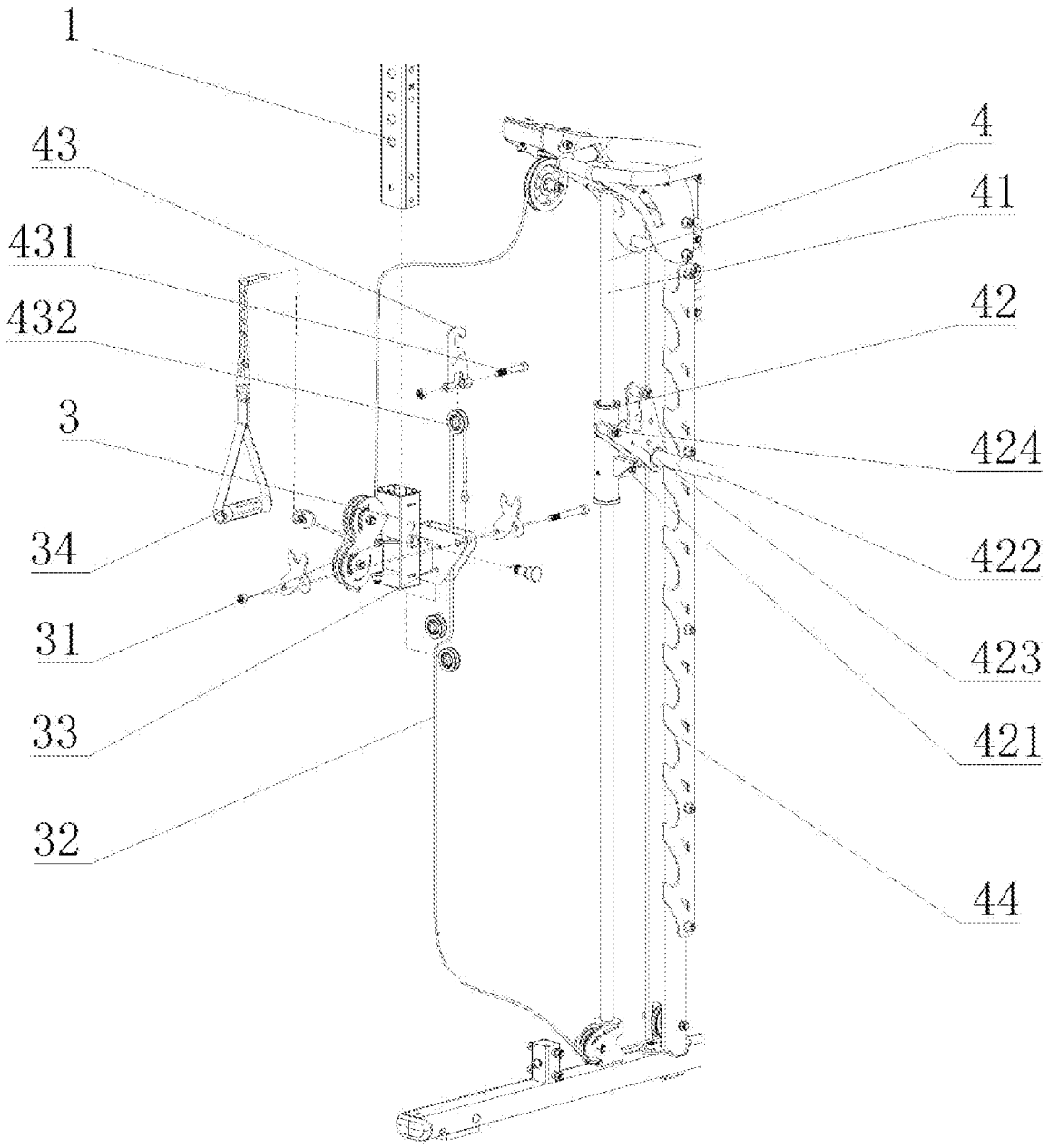
FIG. 3 is a partial exploded view according to the present disclosure.

As shown in FIG. 1 to FIG. 3, the cable mechanism 3 includes sliding rack 31, steel rope 32, and bracket 33. The sliding rack 31 is slidably connected to the front vertical pipe 1. A group of positioning holes are vertically formed in the front vertical pipe 1. A latch is provided on the sliding rack 31. The latch is cooperated with each of the positioning holes, such that a mounting height of the sliding rack 31 can be adjusted. A first end of the steel rope 32 is provided with pull sleeve 34 for a cable machine exercise.

A second end of the steel rope 32 is connected through each of the selected irons 2 and suspension rack 43 to each of the Smith mechanisms 4 for a Smith machine exercise. The steel rope 32 bears a load of the selected iron 2. The Smith mechanism 4 includes guide post 41, suspension rack 43, and adjusting plate 44. The guide post 41 is provided vertically. The guide post 41 is slidably connected to moving rack 42. Barbell bar 422 is horizontally provided at an upper end of the moving rack 42. The barbell bar 422 is rotatably connected to the moving rack 42. The barbell bar 422 is fixedly connected to hook rack 423. The hook rack 423 is triangular. The barbell bar 422 penetrates through one end of the hook rack 423. Two remaining ends of the hook rack 423 are respectively provided with suspension shafts 424. The two suspension shafts 424 are respectively cooperated with the suspension rack 43 and the adjusting plate 44, thereby reducing a rotational amplitude of the barbell bar 422. Support rack 421 is provided on the moving rack 42. The support rack 421 is configured to support the hook rack 423. In a Smith machine exercise, the support rack 421 can restrict rotation of the hook rack 423. This makes the barbell bar 422 stable when the Smith mechanism 4 is used.

A groove cooperated with the suspension shaft 424 is formed in an upper end of the suspension rack 43, such that the suspension shaft 424 is cooperated with the suspension rack 43 stably. In case of weight training in the Smith machine exercise, the groove of the suspension rack 43 can be placed onto the suspension shaft 424 of the hook rack 423. The barbell bar 422 drives the suspension rack 43 to move, thereby allowing the steel rope 32 to pull the selected iron 2. A hexagonal sleeve is horizontally provided at a lower end of the suspension rack 43. A hexagonal groove is formed in an upper end of the bracket 33. The bracket 33 is connected to the sliding rack 31 through a bolt. The hexagonal sleeve is cooperated with the hexagonal groove, such that the suspension rack 43 and the bracket 33 do not slide relatively. Support shaft 431 penetrates through the hexagonal sleeve. The support shaft 431 is rotatably connected to pulley 432. The second end of the steel rope 32 is connected to the bracket 33 through the pulley 432. The Smith mechanism 4 further includes two symmetrical adjusting plates 44. The adjusting plates 44 are provided vertically. A set of unidirectional teeth for placing the barbell bar 422 in the Smith machine exercise are arranged on each of the adjusting plates 44.

The present disclosure has the following working process or working principle:

When the Smith mechanism 4 is connected to a load of the selected iron 2 for an exercise such as raise and deep squat, the sliding rack 31 is adjusted to an appropriate height, and a weight of the selected iron 2 is adjusted. In rotation of the barbell bar 422, the barbell bar 422 is taken down from the adjusting plate 44, and the barbell bar 422 is rotated continuously. The support rack 421 props against the hook rack 423, and moves upward, such that the groove of the suspension rack 43 is placed onto the suspension shaft 424 of the hook rack 423 for an up or down exercise. The hexagonal sleeve of the support shaft 431 on the suspension rack 43 is separated from the hexagonal groove in the upper end of the bracket 33. The suspension rack 43 moves up with the moving rack 42. The barbell bar 422 pulls the steel rope through the moving rack 42, the suspension rack 43 and the pulley 432, thereby pulling the selected iron 2 to exercise the arm. By adjusting the mounting height of the sliding rack 31, not only can an initial position exercised by the Smith mechanism 4 be adjusted to exercise different positions, but also a safety limiting function can be achieved. Upon completion of the exercise, the barbell bar 422 is placed down, the suspension rack 43 falls onto the bracket 33 under a gravity of the selected iron 2, and the load of the selected iron 2 is removed. Compared with a conventional Smith mechanism using a weight plate, this is safer and more reliable.

When the Smith mechanism 4 is not connected to the load of the selected iron 2, but only the barbell bar 422 is used for raise, deep squat, and press, the sliding rack 31 is adjusted to an appropriate height. The groove of the suspension rack 43 is separated from the suspension shaft 424 of the moving rack 42. In rotation of the barbell bar 422, the barbell bar 422 is taken down from the adjusting plate 44, and the hook rack 423 is clamped by the support rack 421 for an up or down exercise. The hexagonal sleeve of the support sleeve 431 is clamped into the hexagonal groove in the upper end of the bracket 33, and the suspension rack 43 is kept unmoved.

When the cable mechanism 3 is used for an exercise, the pull sleeve 34 is provided at the first end of the cable mechanism, a height of the sliding rack 31 is adjusted, and a weight of the selected iron 2 is selected. The pull sleeve 34 is grasped and pulled, thereby realizing a cable machine exercise. When the cable mechanism 3 and the Smith mechanism 4 are switched, the weight is unnecessarily reset, and the same selected iron 2 is used. Any adjustment and disassembly turn out to be unnecessary, the function can be operated independently, the operation is simple, and the material cost is saved.

Descriptions on directions and relative position relationships of the structures in the present disclosure, such as descriptions on front, rear, left, right, upper and lower, are merely for ease of description, rather than a limit to the present disclosure.

What is claimed is:

1. A multifunctional comprehensive training device capable of being grasped stably, comprising front vertical pipes, selected irons, cable mechanisms, and Smith mechanisms, wherein the front vertical pipes are arranged symmetrically and vertically, the selected irons are arranged symmetrically, the cable mechanisms are arranged symmetrically and are respectively provided on the front vertical pipes, and the Smith mechanisms are arranged symmetrically;

the cable mechanisms each comprise a steel rope and a bracket, and a first end of the steel rope is configured for a cable machine exercise;

the Smith mechanisms each comprises a guide post, a suspension rack, and an adjusting plate, and a second end of the steel rope is connected to the Smith mechanism through each of the selected irons and the suspension rack; and the guide post is provided vertically; the guide post is slidably connected to a moving rack; a barbell bar is horizontally provided at an upper end of the moving rack; the barbell bar is rotatably connected to the moving rack; the barbell bar is connected to a hook rack; two suspension shafts are provided on the hook rack; the two suspension shafts are respectively cooperated with the suspension rack and the adjusting plate; a support rack is provided at a lower end of the moving rack; the support rack is configured to support the hook rack; the suspension rack comprises an upper end provided with a groove cooperated with the suspension shaft, and a lower end movably connected to a pulley; the second end of the steel rope is connected to the bracket through the pulley; and unidirectional teeth are provided on the adjusting plate.

2. The multifunctional comprehensive training device capable of being grasped stably according to claim 1, wherein a hexagonal groove is formed in an upper end of the bracket; a hexagonal sleeve is horizontally provided at the lower end of the suspension rack-; the hexagonal sleeve is cooperated with the hexagonal groove; a support shaft penetrates through the hexagonal sleeve; and the support shaft is rotatably connected to the pulley.

3. The multifunctional comprehensive training device capable of being grasped stably according to claim 1, wherein the cable mechanism further comprises a sliding rack; the sliding rack is slidably connected to the front vertical pipe; a group of positioning holes are vertically formed in the front vertical pipe; a latch is provided on the sliding rack; and the latch is cooperated with each of the positioning holes.

4. The multifunctional comprehensive training device capable of being grasped stably according to claim 1, wherein the hook rack is triangular; the barbell bar penetrates through one end of the hook rack; and the suspension shafts are respectively provided at two remaining ends of the hook rack.

5. The multifunctional comprehensive training device capable of being grasped stably according to claim 2, wherein the hook rack is triangular; the barbell bar penetrates through one end of the hook rack; and the suspension shafts are respectively provided at two remaining ends of the hook rack.

6. The multifunctional comprehensive training device capable of being grasped stably according to claim 3, wherein the hook rack is triangular; the barbell bar penetrates through one end of the hook rack; and the suspension shafts are respectively provided at two remaining ends of the hook rack.

* * * * *